US008499465B2

(12) United States Patent
Kuta

(10) Patent No.: US 8,499,465 B2
(45) Date of Patent: Aug. 6, 2013

(54) OPTICAL PUTTER SYSTEM

(76) Inventor: Todd Kuta, Fountain Hills, AZ (US)

( * ) Notice: Subject to any disclaimer, the term of this patent is extended or adjusted under 35 U.S.C. 154(b) by 180 days.

(21) Appl. No.: 13/004,597

(22) Filed: Jan. 11, 2011

(65) Prior Publication Data

US 2012/0174419 A1 Jul. 12, 2012

(51) Int. Cl.
*A63B 57/00* (2006.01)
*A63B 69/36* (2006.01)
*A63B 53/04* (2006.01)

(52) U.S. Cl.
USPC ..... 33/289; 33/333; 473/251; 473/404

(58) Field of Classification Search
USPC ..... 33/289, 333; 473/251, 404
See application file for complete search history.

(56) References Cited

U.S. PATENT DOCUMENTS 2,724,898 A * 11/1955 Douglass ..... 33/276
2,919,491 A * 1/1960 Darrell et al. ..... 33/334
3,186,092 A * 6/1965 Bertas ..... 33/277
3,306,618 A * 2/1967 Liljequist ..... 473/241
3,535,792 A * 10/1970 Douglas ..... 33/283
4,260,151 A * 4/1981 Weaver ..... 473/404
4,824,114 A * 4/1989 Catalano ..... 473/251
4,927,151 A * 5/1990 Ronnick ..... 473/241
5,330,179 A * 7/1994 Hampel ..... 473/404
5,403,001 A * 4/1995 Skorpinski ..... 473/409
5,435,562 A * 7/1995 Stock et al. ..... 473/220
5,452,897 A * 9/1995 Mick ..... 473/409
5,492,322 A * 2/1996 Smith ..... 473/404
5,503,393 A * 4/1996 Casperson ..... 473/404
5,640,777 A * 6/1997 Densberger et al. ..... 33/263
5,755,623 A * 5/1998 Mizenko ..... 473/241
5,846,140 A * 12/1998 Hoburg ..... 473/240
6,129,641 A * 10/2000 Burch ..... 473/404
6,165,083 A * 12/2000 Stenger et al. ..... 473/404
6,997,823 B2 * 2/2006 Garza ..... 473/407
7,252,596 B1 * 8/2007 Matousek ..... 473/226
7,288,032 B2 * 10/2007 Chabala ..... 473/404
7,731,598 B1 * 6/2010 Kim ..... 473/226
2003/0130069 A1 * 7/2003 Baird ..... 473/404
2008/0242435 A1 * 10/2008 Cho ..... 473/223
2009/0017943 A1 * 1/2009 Landry ..... 473/404

* cited by examiner

*Primary Examiner* — Christopher Fulton
(74) *Attorney, Agent, or Firm* — Snell & Wilmer L.L.P.

(57) ABSTRACT

A system and method for calibration of golf shots is provided. Specifically, a tool for providing a reference target superimposed over a magnified image of the cup for calibration purposes is provided. An optical putter calibration tool may include an eye lens; an object lens; a target lens; a beam splitter; and a target reticle. The eye lens, the object lens, the target lens, the beam splitter and the target reticle may be integrated in a shaft of a golf club, such as a putter, for providing a simultaneous magnified view and projecting a reticle image. Comparison of the reticle image and the magnified view may provide a reading of a playing surface characteristic.

16 Claims, 8 Drawing Sheets

OPTICAL PUTTER SYSTEM

FIELD

A system and method for calibration of golf shots is provided. Specifically, a tool for providing a reference target superimposed over an image of the cup for calibration purposes is provided.

BACKGROUND

The game of golf is played by performing a number of shots to move a ball from a teeing ground to the fairway and/or to the green, and into the hole or cup. The art of putting is considered by many to be the easiest way to quickly improve ones score and is often considered the final determining factor for a player to improve from a good player to an exceptional player. The art of putting is based upon two key premises; the line (or path) and pace (or speed) of the rolling ball towards the cup. The faster the pace the less a putt breaks. Thus, the line is at least partially determined by the pace of the putt. Pace is affected by various factors such as: force of the club, the length and grain of the grass, conditions of the playing surface, break of the playing surface and whether a putt is uphill or downhill.

Ascertaining the correct pace and line for the conditions of the green is generally a golfer's first step to putting the ball in the cup. The second part of the putting process is the actual putting stroke. The putting stroke is honed through practice and repetition.

Examples of top tier golfers using plumb bobbing in an effort to read putts are abundant throughout the modern history of golf. The most common way to plumb bob is to stand in line with the lie of the ball to the cup and lightly hold a club, such as the putter, between two fingers near the end of the shaft and position the straight bottom edge of the grip or manufacturers information band (level line) visually next to the cup and allow gravity to pull the reference point to level. The golfer then uses their dominant eye to evaluate whether the top surface of the cup is level with or slopes away in either direction from the level line. This method has several issues which limits its effectiveness. It is often difficult to assess subtle pitches, especially on longer putts. Moreover, few putter shafts are perfectly vertical in the requisite dimensions (unless they are perfectly balanced) which leads to error.

The current method does not provide a mechanism for assessing whether a putt is uphill or downhill. Also, the current method does not provide a method for confirmation and/or verification of a players' read. Additionally, the average golf participant is a male between the ages 45-65 years of age. A major problem for participants this age is the deterioration of their eyesight. This limits the effectiveness of the plumb bobbing technique.

SUMMARY

A method, system, and calibration tool are provided to cure the aforementioned limitations of the traditional plumb bobbing technique and to aid a golfer's effectiveness in reading putts. In an exemplary embodiment, a method for an optical putter calibration tool is disclosed. The optical putter calibration tool may comprise an eye lens integral to a putter. The lens may provide a magnified view of and/or a target reticle image. Comparison of the reticle image and the magnified view may provide a reading of the playing surface characteristics. As used herein, "calibration" and "alignment" may be used interchangeably and generally refer to lining up putts effectively.

In an embodiment, the optical putter calibration tool may comprise an eye lens; an object lens; a target lens; a beam splitter; and a target reticle. In one embodiment, the eye lens, the object lens, the target lens, the beam splitter and the target reticle are integrated in a shaft of a golf club, such as a putter, for providing a magnified view and projecting a reticle image simultaneously. Similar to above, comparison of the reticle image and the magnified view may provide a reading of the playing surface characteristics.

The eye lens and the object lens may be configured as a Galilean telescope. The target lens, beam splitter, and target reticle may be configured as a collimated reticle to produce a collimated reticle image. In some embodiments, the target reticle may include gradient indicators.

A light source may be provided to illuminate the target reticle. The light source may be luminescence, a LED coupled to a power source, self illuminating, and/or a window. The optical putter calibration tool may include a bubble level and/or spirit level. The magnification may be between about 1.5 and 2 times magnification, such as about 1.7 times, though other magnification power is also suitable. In various embodiments, the magnification is a function of the diameter of the shaft of the club. Reading the playing surface characteristic may include a reading of flat, uphill, downhill, sloping left, and/or sloping right.

The optical putter calibration tool may be configured to provide a verification of the first reading when utilized along the fall line of the playing surface. The reticle image may be a simultaneously superimposed magnified view of the cup. The eye lens and the object lens may be optically coupled together in a plane normal to the axis of the shaft of the golf club. In some embodiments, taking a second reading along the fall line of a cup results in a verification of a first reading taken along the path of a ball to the cup.

In an embodiment, a method of drawing an inference of the slope of a golf green is disclosed. This method may include viewing a magnified image of a cup simultaneously with a target reticle image along a proscribed path of the ball; comparing the orientation of the magnified image of the cup with the orientation of the target reticle image; and determining, based on the comparing, the playing surface slopes to the left of the cup, to the right of the cup, uphill towards the cup, downhill towards the cup, and/or is flat. The method may also include verifying the determination by viewing a magnified image of the cup simultaneously with a second target reticle image along a fall line of the cup; comparing the orientation of the magnified image of the cup with the orientation of the second target reticle image; and determining, based on comparing the orientation of the magnified image of the cup with the orientation of the second target reticle image and the comparing the orientation of the magnified image of the cup with the orientation of the target reticle image, the playing surface slopes to the left of the cup, to the right of the cup, uphill towards the cup, downhill towards the cup; and/or flat.

The viewing of the magnified image of the cup simultaneously with the target reticle image along a proscribed path of the ball further comprises viewing a gradient indicator reading. The gradient reading and/or a booklet notation may aid in determining the amount of force to apply to the ball.

BRIEF DESCRIPTION OF THE DRAWING FIGURES

A more complete understanding of the present invention may be derived by referring to the detailed description and claims when considered in connection with the drawing figures, wherein like reference numbers refer to similar elements throughout the drawing figures, and:

DETAILED DESCRIPTION OF THE INVENTION

While exemplary embodiments are described herein in sufficient detail to enable those skilled in the art to practice the invention, it should be understood that other embodiments may be realized and that logical material, electrical, and mechanical changes may be made without departing from the spirit and scope of the invention. Thus, the following detailed description is presented for purposes of illustration only.

In one embodiment, a putting methodology, system and device is disclosed which may utilize a golf club, such as a putter, comprising an integrated specialized viewing area that may magnify the cup and superimpose or otherwise project an image in the viewing area that can be used as a point of reference to more accurately and consistently read the pace and line of the putt. In one embodiment a putter comprising at least one integral lens is provided. This lens may be used for magnifying a view image. A user may use personal experience coupled with the advantages and improvements of the device to hone their putting skill. Moreover, the device may be customizable to individually suit the desires of the user.

Figure 1:
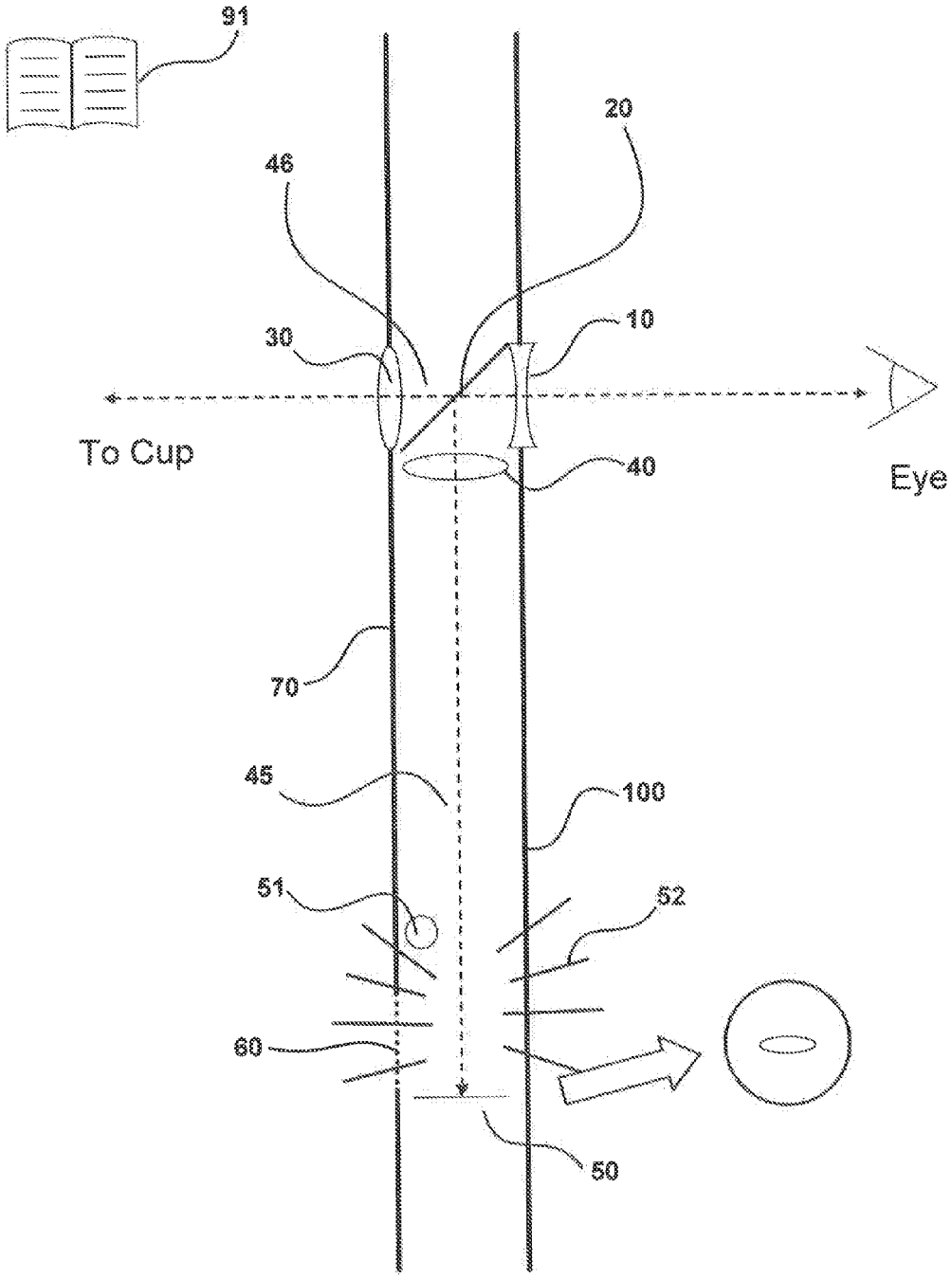
FIG. 1 illustrates the components of an optical putter calibration tool according to an exemplary embodiment.

With reference to FIG. 1, an exemplary optical putter calibration tool is provided. In one embodiment, optical putter calibration tool 100 comprises an eye lens 10, a beam splitter 20, an objective lens 30, a target lens 40, and a target reticle 50. In some embodiments, optical putter calibration tool 100 further comprises an illumination window 60 and/or an optical path 45. Window 60 may comprise a transparent surface allowing light outside of shaft 70 to provide light to target reticle 50.

In various embodiments, eye lens 10 may be a negative (e.g., concave lens). Eye lens 10 may be an optical device with substantially perfect or approximate axial symmetry which transmits and refracts light, converging or diverging a beam of light. Though eye lens 10 is described as consisting of a single optical element, it may be an element of an optical system, such as a Galilean telescope. Eye lens 10 is generally the lens most near the eye when a user is looking through optical putter calibration tool 100. As seen in FIG. 1, eye lens 10 is oriented substantially parallel to the axis of shaft 70. In one embodiment, the diameter of eye lens 10 is a function of the diameter of shaft 70. In this manner, the width of eye lens 10, which is generally positioned near, or in line with, the exterior surface of shaft 70, may be no wider than the curved exterior surface of shaft 70.

With continued reference to FIG. 1, objective lens 30 may be configured to collect light and brings the light to focus creating an image. In various embodiments, objective lens 30 may be a positive (e.g., convex lens). Objective lens 30 may be oriented substantially parallel to the axis of shaft 70. In one embodiment, the diameter of objective lens 30 is a function of the diameter of the shaft. In this manner, similar to eye lens 10 described above, the width of objective lens 30, which is positioned near, or in line with, the exterior surface of shaft 70, may be no wider than the curved exterior surface of shaft 70.

In some embodiments, the lenses of optical putter calibration tool 100 are permanently mounted in the optical putter calibration tool 100, causing the lenses to have a fixed predetermined magnification and field of view. Eye lens 10 and objective lens 30 may be situated such that the focal point of the eye lens 10 is the same as the focal point for objective lens 30.

Objective lens 30 may be configured to work in concert with eye lens 10 to provide a pre-selected image magnification. The pre-selected image magnification may be any suitable magnification, such as a magnification between about 1.5 times to about 2 times, though other magnification power are also suitable and contemplated. For instance, the pre-selected image magnification may be about 1.7 times magnification. The magnification may be configured to be a function of the distance between objective lens 30 and eye lens 10. For instance, the focal length of eye lens 10, combined with the focal length of objective lens 30, to which eye lens 10 is optically coupled, may determine the magnification. In some embodiments, the separation and/or diameter of one or more lens is a function of the diameter of the club shaft 70 at the mounting location.

The magnification provided by the optical putter calibration tool 100 may help overcome the issue of discerning subtle pitches. Also, the magnification may aid those with deteriorated or non-ideal eyesight to, for instance, discern the slope of the playing surface and/or see the cup. In various embodiments, optical putter calibration tool 100 comprises specialized channels 45, 46 to direct light from object lens 30 through beam splitter 20 to eye lens 10 and/or from target reticle 50 through target lens 40 to beam splitter 20. With the exception of optical enhancers, such as a lens and/or beam splitter, these channels may be free of structural interference and/or comprise properties for assisting in transmitting beams of light.

With renewed reference to FIG. 1, eye lens 10 may be optically coupled to objective lens 30 through beam splitter 20 (along channel 46). Beam splitter 20 may be an optical device that splits a beam of light in two. In this manner, beam splitter 20 may be an optical element that allows part of an electromagnetic wave to pass through while reflecting the other part. With continued reference to FIG. 1, beam splitter 20 may be configured and/or oriented such that a first portion of a beam of light passes from objective lens 30 through beam splitter 20 through eye lens 10 to the eye and a second portion of a beam of light is "split" and is directed from target reticle 50 through target lens 40 through beam splitter 20 through eye lens 10 to the eye. In this embodiment, beam splitter 20 may be positioned approximately midway between eye lens 10 and objective lens 30. The beam of light passing from objective lens 30 through beam splitter 20 to eye lens 10 may be substantially normal to the axis of shaft 70 and the beam of light passing from the target reticle 50 through target lens 40 to beam splitter 20 may be directed substantially parallel to the axis of shaft 70 (while traveling in optical path 45).

The focal length of target lens 40 and the scale of a target reticle 50 (described further below) are selected to produce a reference target of a pre-selected size. For instance pre-selected such that when viewed by the eye the target reference may exactly match the size and shape of the magnified cup. In one embodiment, the illumination of target reticle 50 is provided via a window 60 on shaft 70 of the club. FIG. 1 depicts target reticle 50 being used in reflection with top illumination. In another embodiment, transmissive targets may be used by placing the window below target reticle 50. In another embodiment, optical putter calibration tool 100 may comprise a battery operated light source for illuminating target reticle 50, such as via a LED 51. In some embodiments, target reticle 50 may be coated with luminescent materials and/or self illuminating (depicted as light rays 52), such as by using a radioactive element (i.e, Tritium).

In one embodiment, target reticle 50 may be customizable from a variety of reference targets and or selectable from a variety of reference targets. In one embodiment, this reference target may be scalable to accommodate a preferred use by the user, such as the size of the reference target may be scaled based on the preferred distance of use from the cup (X) or height above the ground (Y). In an embodiment, a first target reticle 50 may be exchanged with a second target reticle 50 with different properties. These properties may include color of elements, size of elements, contrast of elements, gradient indicators, placement of elements and/or the like. For instance, to accommodate a color bind user, varied levels of light, and/or a shorter user. Second target reticle 50 may be integral to optical putter calibration tool 100 such as by inverting target reticle 50 from a first side to a second side. In an embodiment, target reticle 50 may be provided by a battery powered digital display with customizable properties. For instance, battery powered digital display target reticle 50 may display a first image of a first size and first color and display a second image of a second size and second color and/or combinations thereof. In an embodiment, target reticle 50 using a battery powered digital display may display a first image of an ovoid designed to approximate the shape and scale of the direct view of the cup. This target reticle 50 may display a different second image such as, a second image of an axis with lines emanating in 45 degree increments with radiating gradient hash mark indicators. In one embodiment, first target reticle 50 may be removed and/or replaced by a non-integral second target reticle 50, such as by replacing a card or disc. In one embodiment, the light source illuminating target reticle 50 may be removed, or turned off by removing the target reticle image 80 displayed to the user leaving the magnified direct view of cup (or viewed image) remaining This may aid the user in viewing the magnified view of the cup. This removal may be by any suitable method such as covering window 60 with a covering and/or removing power to an electronic light source.

In some embodiments, the relative brightness of target reticle image 80 and direct cup image 90 may be adjusted by altering the reflectivity of beam splitter 20. In one embodiment, beam splitter 20 is a 50/50 beam splitter where about half of the light is transmitted through beam splitter 20 and about half of the light is reflected. This ratio may be adjusted by changing the reflectance of beam splitter 20, such as during fabrication, for example, to a ratio of 70/30, or other ratio depending on a particular application.

Target reticle 50 is depicted as being located below beam splitter 20 towards the face of the club on shaft 70; however target reticle 50 may be positioned above (an inverted) beam splitter 20 towards the grip of the club. In this manner, a second system with the same or different optical properties could be implemented in the same club and shaft either below or above first optical putter calibration tool 100. Alternatively, a second system with the same orientation as shown in FIG. 1 may be located above or below first optical putter calibration tool 100 in shaft 70.

With reference to FIGS. 2A-2E, in an exemplary embodiment, target reticle 50 comprises an ellipsoid or oval shaped target. This target, along with the other components of the optical putter calibration tool 100, is configured to present a superimposed enlarged target reticle image 80 over the enlarged direct image 90 (e.g. the cup). By comparing direct view image 90 of the cup to the location of and properties of target reticle image 80 the surface features of the playing surface can be surmised. For instance, a user may stand a specified distance away from the cup (X) with optical putter calibration tool 100 held at a specified height (Y) above the ground in a line with the users ball's path to the cup, where the user and the ball are on the same side of the cup (as shown in FIGS. 3A-3B).

Due to the golf cup being a finite diameter (standard of 4.25 inches) direct view 90 of the cup from a specific distance (X) and specific height (Y) is the same if the putt and/or playing surface is flat. With this in mind, target reticle image 80 can be calibrated to be that exact shape and size as direct view 90 cup image from a pre-selected specific distance (X) and height (Y). In one embodiment, the pre-selected distance optical putter calibration tool 100 is positioned away from the cup a particular distance (element X as depicted in FIGS. 3A-3C), such as between about 6-22 feet from the cup. For instance, the pre-selected distance (X) may be about 14 or about 16 feet from the cup. This distance (X) may be scalable and/or customizable to the user. In this manner, target reticle 50 may be shaped larger or smaller to accommodate the distance away from the cup the user desires to hold optical putter calibration tool 100.

Figure 3A:
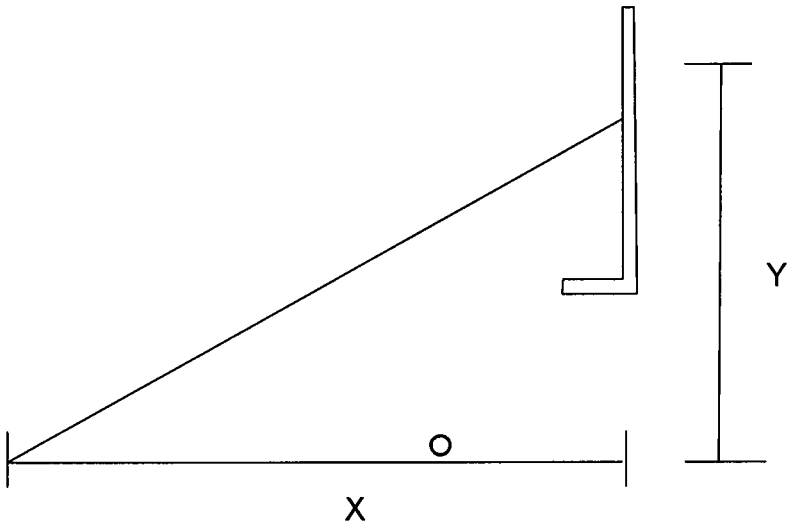
FIGS. 3A-3B illustrate exemplary positioning of an optical putter calibration tool while in use for making a first reading according to various exemplary embodiments.
Figure 3B:
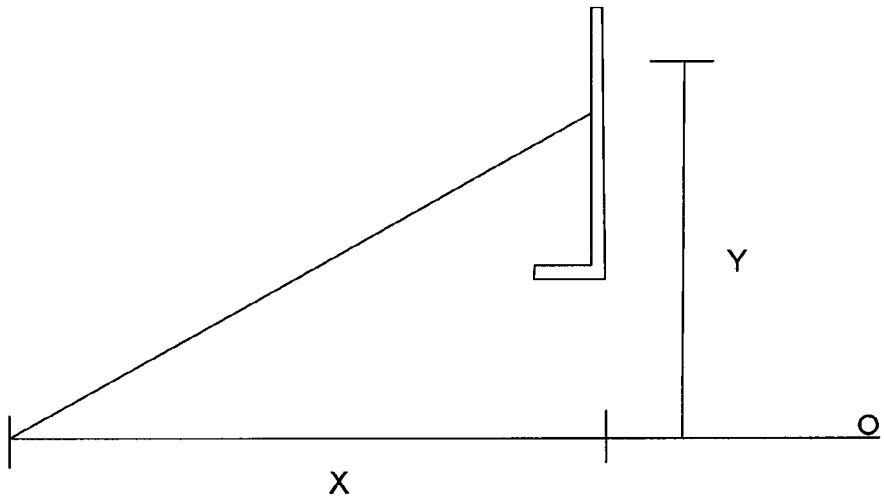
Figure 3C:
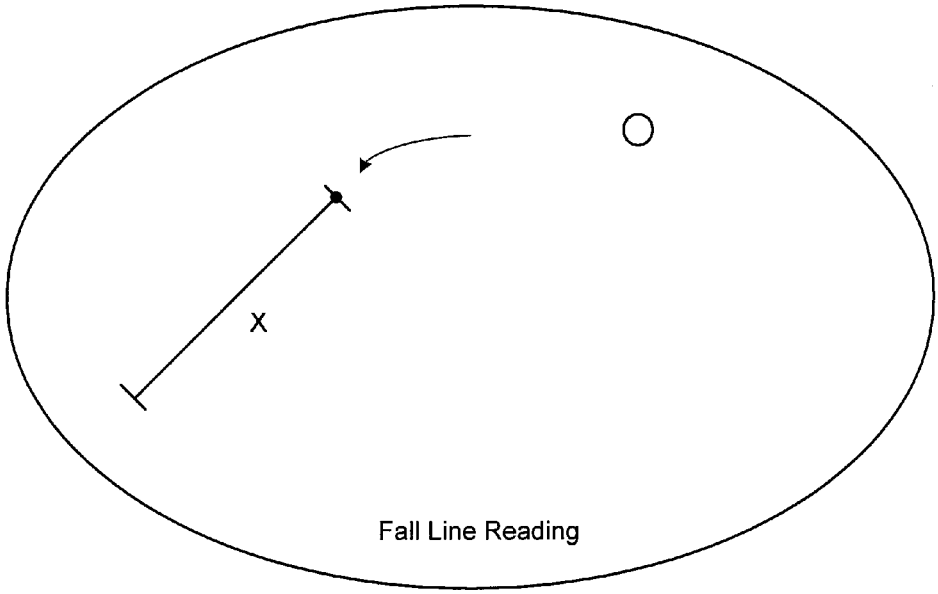
FIG. 3C illustrates an exemplary positioning of an optical putter calibration tool while in use for verification of an established first reading according to an exemplary embodiment.

Similarly, the distance optical putter calibration tool 100 is positioned above the ground is a pre-selected particular distance (element Y as depicted in FIGS. 3A-3C), such as between about 3 and 6 feet. For instance, the pre-selected distance (Y) may be about 4.5 or about 5 feet above the ground. This distance may be measured at the level of eye lens 10 in shaft 70 of the club rather than the base and/or club head of the putter. This distance (Y) may be scalable and/or customizable to the user. In this manner, target reticle 50 may be shaped larger or smaller to accommodate the height (Y) the user desires to hold optical putter calibration tool 100 above the ground, such as to accommodate users of differing heights.

Figure 2A:
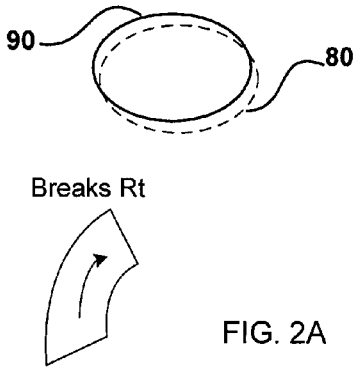
FIGS. 2A-2E illustrate the comparison of a direct view image superimposed with a target reticle image according to various exemplary embodiments.
Figure 2B:
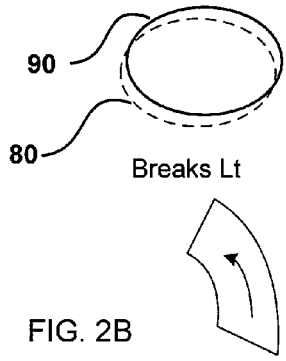
Figure 2C:
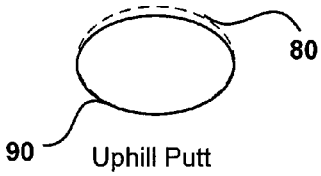
Figure 2D:
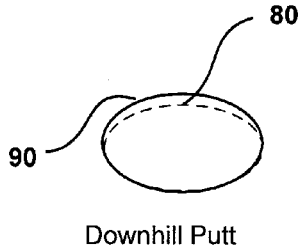
Figure 2E:
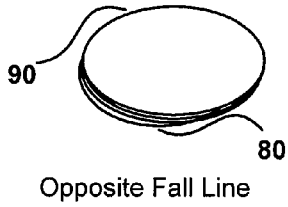

In one embodiment, target reticle image 80 is substantially the same size and substantially the same shape as direct view image 90 of the cup when the cup is viewed from the pre-selected distance (X) and height (Y). If direct view image 90 of the cup and target reticle image 80 substantially overlap as perceived by the user, the user can infer that the playing surface is substantially flat. However, if (as depicted in FIG. 2A) target reticle image 80 is to the right of direct view image 90 of the cup, the user can infer that the golf ball's tendency is to break to the right from its current direct path lie and that the playing surface slopes to the right. An example of what direction is meant by "breaking to the right" is depicted in FIG. 2A. Conversely, if (as depicted in FIG. 2B) target reticle image 80 is to the left of direct view image 90 of the cup, the user can infer that golf ball is likely to break to the left and that the playing surface slopes to the left. An example of what direction is meant by "breaking to the left" is depicted in FIG. 2B. If (as depicted in FIG. 2C) target reticle image 80 is above direct view image 90 of the cup the user can infer that the playing surface slopes uphill. If (as depicted in FIG. 2D) the target reticle image 80 is below the direct view image 90 of the cup, the user can infer the playing surface slopes downhill. After the user has calibrated the speed and line the user can step down to the low side of the cup holding the optical putter calibration tool 100 a prescribed distance (X) and prescribed height (Y) and use the viewing area to confirm what is known in the trade as the "Fall Line." By moving along the low side of the cup until image 90 of the cup is level with projected target reticle image 80 a users' read of the playing surface can be verified (as depicted in FIGS. 2E, and 3C). For instance, along this path, the direct view image 90 of the cup and target reticle image 80 should substantially overlap completely.

Figure 4A:
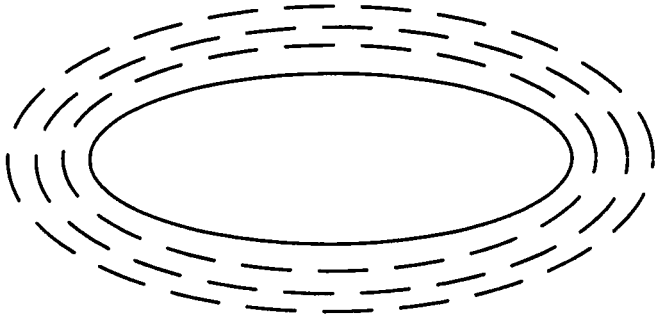
FIGS. 4A-4B illustrates exemplary embodiments of target reticles having gradient lines and/or gradient indicators.

Additionally, in some embodiments, the target reticle 50 and target reticle image 80 may comprise gradient indicators (See FIGS. 4A-4B) such as markings, dashed lines, dots, crosshairs, posts, circles, ovoid shapes, scales, chevrons, hashes, grid markings, and/or targets. In one embodiment, these gradients indicators comprise dashed ovoid shaped rings proportional to direct view image 90 of the cup. Gradients indicators may be below, to the left and/or to the right of a solid or dashed ovoid shape and when compared with direct view 90 of the cup may provide a means of calibrating the amount of beak in the playing surface. For instance, direct view 90 of the cup as viewed from a pre-selected distance (X) from the cup and a pre-selected height (Y) above the ground in line with the path of the ball to the cup may provide a means of calibrating the amount of beak in surface features the lie of the path of the ball to the cup.

For instance, if direct view 90 of the cup overlaps 2 gradient lines a user can surmise that the slope of the playing surface is more severe than if direct view 90 of the cup overlaps a single gradient line. A user may calibrate the ball speed needed to overcome this slope of the playing surface based on personal experience. In some embodiments, a calibration booklet 91 may be provided to allow the user to document the amount of force or pace needed per gradient marking in their putting practice, such as prior to the round. This calibration booklet 91, may comprise paper and pen, and/or may comprise an electronic computer application, such as an application operated by a processor on a mobile device or hand held computing unit. This calibration booklet 91 may be an application saved to a non-transitory computer readable medium. The booklet 91 may be used to record how much force per gradient line of break is needed to correct for various playing surface variations.

Figure 4B:
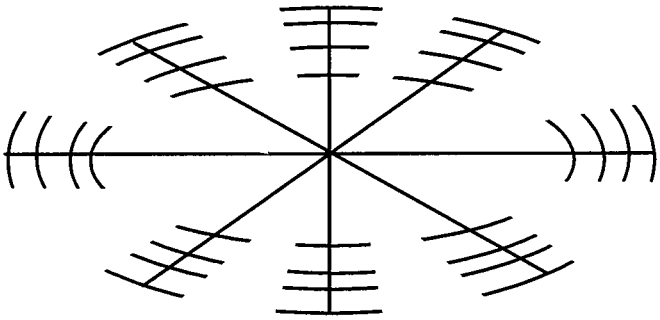

In some embodiments, the gradient indicators in various locations comprise different colors or line thickness to represent and assist in delineating relative position. Additionally, the gradient indicators may comprise stadia marks. These stadia marks, also called stadia lines or stadia hairs, may be crosshairs on target reticle 50 and target reticle image 80 that allow stadiametric range finding. Also, the target reticle 50 may be subdivided into sections. For instance, (as shown in FIG. 4B) target reticle 50 comprising a target image segmented into quadrants by segmenting lines or segmenting colors. In one embodiment, target reticle 50 may comprise engraved lines, embedded fibers and/or an image directly on eye lens 10 such as a laser image (thus eliminating beam splitter 20, target lens 40 and a down-shaft target reticle 50). In various embodiments, the target reticle 50 may be replaced by a computer-generated image superimposed and/or holographic image on a screen or eye lens 10 (similarly eliminating beam splitter 20, target lens 40 and a down-shaft target reticle 50). A user may calibrate the ball speed needed based on personal experience with stadia mark readings.

In an exemplary embodiment, direct view image 90 (such as the cup) can be focused by moving eye lens 10 nearer and further from objective lens 30. This movement of eye lens 10 may be performed by actuating a focusing mechanism allowing movement of the channel in which eye lens 10 is mounted, without needing to manipulate eye lens 10 directly.

Figure 5A:
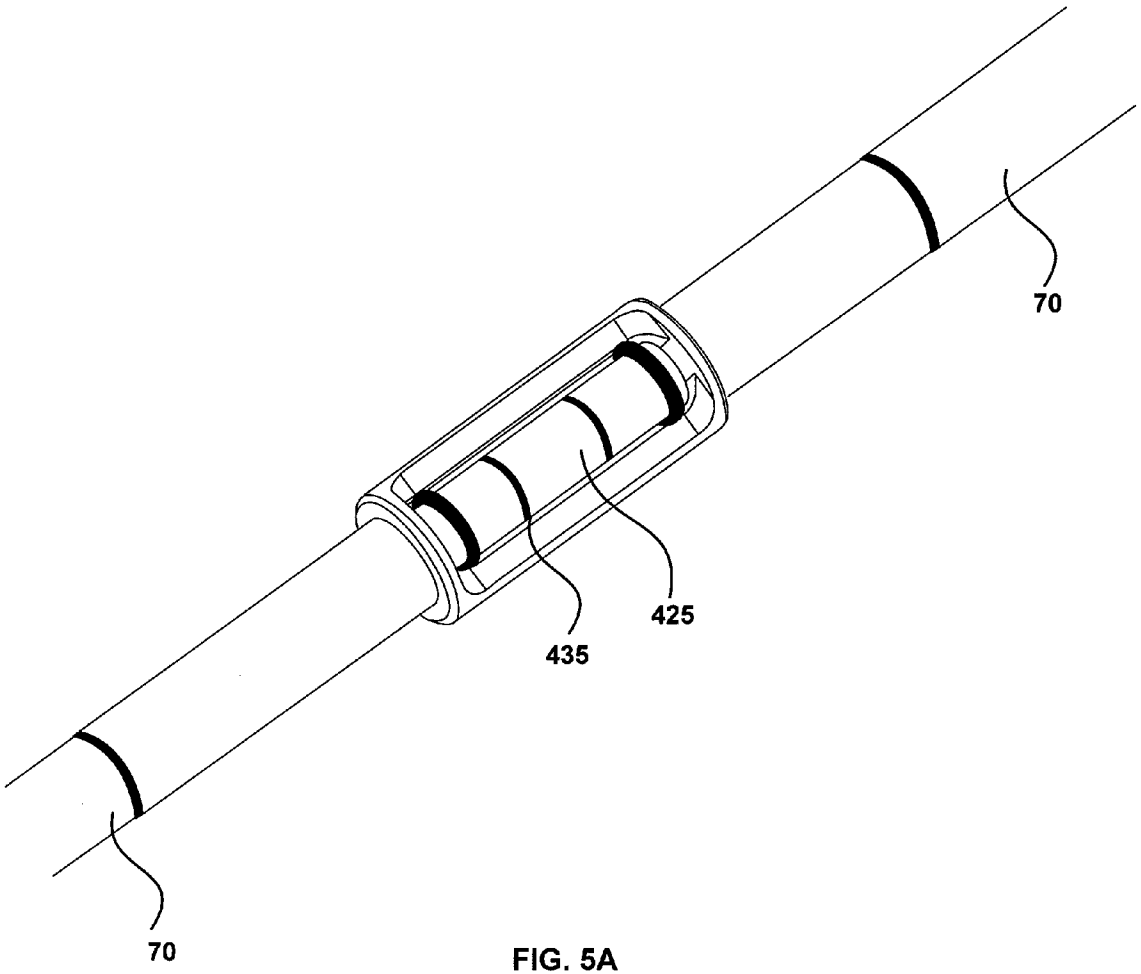
FIGS. 5A-5B illustrate optical putter calibration tools according to various embodiments.
Figure 5B:
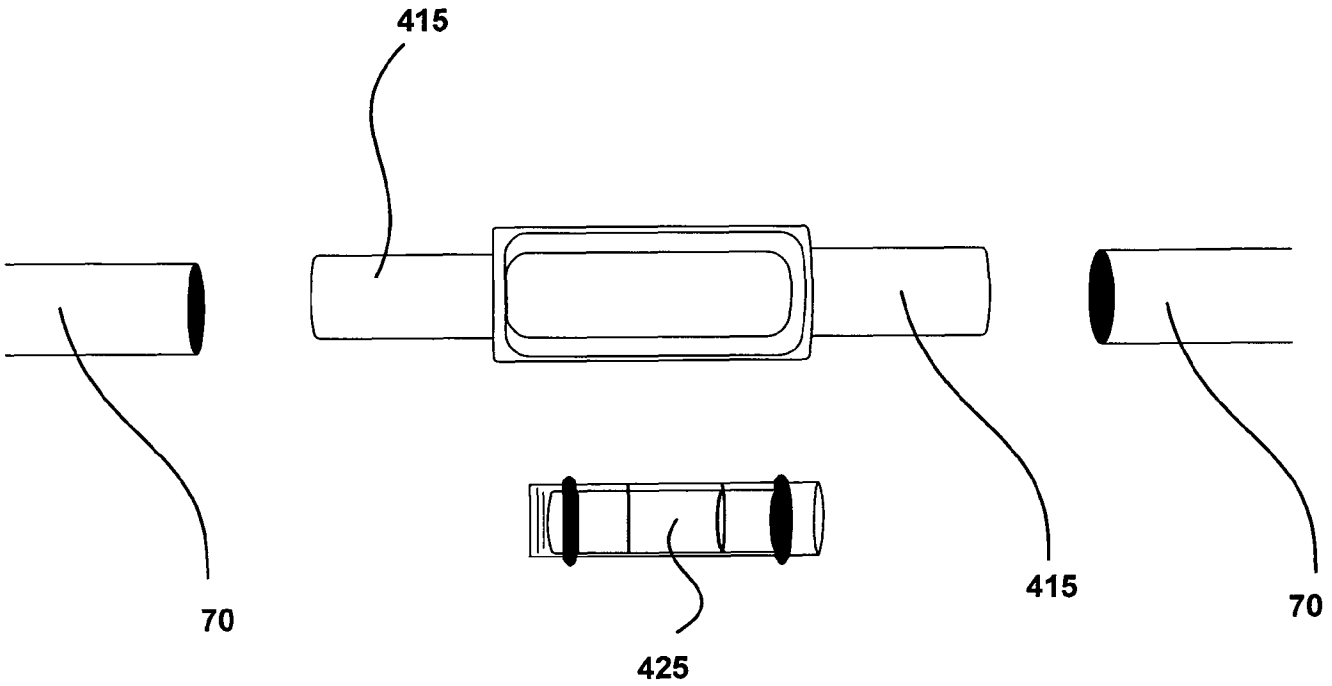

In some embodiments, and with reference to FIGS. 5A-5B, optical putter calibration tool 100 comprises visual indicator 425 to aid the user in determining the make up of the playing surface. For instance, optical putter calibration tool 100 may comprise a level indicator such as a spirit level or bubble level. In another embodiment, the indicator may be a floating body, such as a floating plane or other shape. The visual indicator 425 may be oriented in any plane. For instance, the orientation may be horizontal (level) or vertical (plumb) or a combination thereof, such as with a floating T or cross shape. In this manner, a user could use the level indicator rather than the balance of the club, or straight edge of shaft 70 to determine if the club is being held in the proper orientation. The user may compare the top surface of the cup and/or playing surface surrounding the cup to the results of visual indicator 425 directly. A user may compare the known level straight edge or marking on the club shaft 70 to the surface level of the cup to infer the surface features of the playing surface. In one embodiment, rings 435 (or notches) may designate proper orientation of the bubble or floating plane if the surface was level. Also, a user may use the visual indicator 425 to properly hold and orient the club while applying the optical putting system. In some embodiments, the spirit level may comprise a bulls' eye level. The spirit level may be use in place of or in addition to the optical elements such as the Galilean telescope and collimated reticle features of optical putter calibration tool 100.

In one embodiment, optical putter calibration tool 100 may comprise a level indicator such as a laser indicator. This laser indicator may be horizontal (level) and/or vertical (plumb). This laser indicator may be presented simultaneously with a direct view of the cup (or with a magnified direct view 90 of the cup). In another embodiment, the laser indicator may be displayed in a separate window.

Though the components and features of optical putter calibration tool 100 may extend beyond the diameter of the standard putter shaft, in various embodiments, optical putter calibration tool 100 components are designed to be contained within the dimensions of the standard putter shaft 70. In this manner, a user holding shaft 70 might not notice shaft 70 comprised optical putter calibration tool 100 until further visual inspection of shaft 70.

In various embodiments, optical putter calibration tool 100 may be integral to the putter, such as with a partial haft, a half shaft, or full shaft top and/or bottom extension. In various embodiments, optical putter calibration tool 100 may be designed as an insert into a golf shaft, such as an aftermarket reconfiguration of an exiting putter. In various embodiments, optical putter calibration tool 100 may comprise coupling members 415 to be press fit and/or fastened via glue, or epoxy into a shaft and/or partial shaft of a club. Coupling members 415 may be on the top and/or bottom of optical putter calibration tool 100 to couple with a partial shaft with grip, a partial shaft with club head and/or a partial shaft portion. For instance, coupling members 415 may be round segments shaped to mirror the inside dimensions of a club shaft. In this manner, optical putter calibration tool 100 may be inserted into an existing club by removing an equivalent portion of the existing club shaft and inserting optical putter calibration tool 100 in the equivalent portion of the existing club shaft's place. In one embodiment, this does not alter the physical length or diameter of the existing shaft.

In various embodiments, a ranging device may be built into optical putter calibration tool 100. For instance, the ranging device may be configured to determine the actual or approximate distance optical putter calibration tool 100 is from the cup and/or the distance optical putter calibration tool 100 is above the ground. Thus, optical putter calibration tool 100 and/or imbedded rangefinder may utilize lasers, stadia marks, displays, memory, power sources, and/or the turning of a calibrated wheel. For instance, in one embodiment, optical putter calibration tool 100 may direct a beam of infrared light such as a laser at a target. When the pulses are directed at a target and then reflected they are captured by receiving optics. By measuring the time from transmission to reception the rangefinder may calculate the distance to the target.

The aforementioned lenses may be made of any suitable material. For instance, any of the lenses described above may be made from a molded plastic, glass, polycarbonate, trivex, and/or aspheric material. Any of the aforementioned lenses may be treated with anti-reflective coatings, scratch-resistant coatings, ultraviolet treatments, polarization and/or photochromatic treatment. Any of the aforementioned lenses may be high index glass or plastic lenses. Any of the aforementioned lenses may be customized to accommodate the eyesight of the user such as by replicating a prescription.

In some embodiments, images as seen through the optical putter calibration tool 100, such as the image provide to the viewer through eye lens 10, can be recorded as a picture and/or video onto a storage device, such as an internal or removable memory via an internal image capture mechanism. In one embodiment, this image may be compared to a verification reading taken on the fall line, such as on a display integral to the club.

There are a number of considerations involved in optimizing the design of the optical system. Important variables include the separation of the lenses, such as the distance between eye lens 10 and objective lens 30, the desired magnification of optical putter calibration tool 100, the distance optical putter calibration tool 100 is placed in front of the golfer's eye when in use, the lens diameters, the field of view of the optical system, and the minimum distance of optical putter calibration tool 100 to the cup. The field of view is a measure of how much of the green surrounding the cup is seen when looking through the system. Given these considerations, one skilled in the art of optical design would be able to analyze these tradeoffs to optimize the system for the intended purpose and within the overall system constraints.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

What is claimed is:

1. An optical putter calibration tool comprising:

An eye lens integral to the shaft of a putter, wherein the eye lens provides a simultaneous magnified view and a target reticle image, wherein comparison of the target reticle image and the magnified view provide a reading of playing surface characteristic;

an objective lens;

a target;

a beam splitter; and a target reticle.

2. The optical putter calibration tool of claim 1, wherein the eye lens and the objective lens further comprise a Galilean telescope.

3. The optical putter calibration tool of claim 1, wherein the target lens, beam splitter; and target reticle further comprise a collimated target reticle image.

4. The optical putter calibration tool of claim 1, wherein the target reticle further comprises gradient indicators.

5. The optical putter calibration tool of claim 1, further comprising a light source to illuminate the target reticle, wherein the light source comprises at least one of luminescence, a LED coupled to a power source, self illuminating coating, and a window.

6. The optical putter calibration tool of claim 1, further comprising at least one of a bubble level or spirit level.

7. The optical putter calibration tool of claim 1, wherein the magnification of the magnified view is between about 1.5 and 2 times magnification.

8. The optical putter calibration tool of claim 1, wherein the magnification of the magnified view is a function of the diameter of the shaft of the club.

9. The optical putter calibration tool of claim 1, wherein the magnification of the magnified view is about 1.7 times.

10. The optical putter calibration tool of claim 1, wherein the target reticle image is simultaneously superimposed with the magnified view of a cup.

11. The optical putter calibration tool of claim 1, wherein the eye lens and the objective lens are optically coupled together in a plane normal to the axis of the shaft of the golf club.

12. A method of drawing an inference of the slope of a golf green comprising:

viewing a magnified image of a cup simultaneously with a target reticle image along a proscribed path of the ball;

comparing the orientation of the magnified image of the cup with the orientation of the target reticle image; and determining, based on the comparing, the playing surface slopes at least one of: to the left of the cup, to the right of the cup, uphill towards the cup, downhill towards the cup; or is flat.

13. The method of claim 12, further comprising viewing a magnified image of the cup simultaneously with a second target reticle image along a fall line of the cup;

comparing the orientation of the magnified image of the cup with orientation of the second target reticle image; and verifying the determined slope of the playing surface, based on the comparing the orientation of the magnified image of the cup with orientation of the second target reticle image.

14. The method of claim 12, wherein the viewing of the magnified image of the cup simultaneously with the target reticle image along the proscribed path of the ball further comprises viewing a gradient indicator reading.

15. The method of claim 14, further comprising:

determining the amount of force to apply to the ball based on the gradient indicator reading.

16. The method of claim 14, further comprising:

determining the amount of force to apply to the ball based on the gradient indicator reading and corresponding booklet notation.

* * * * *